US008555655B2

(12) United States Patent
Benz et al.

(10) Patent No.: US 8,555,655 B2
(45) Date of Patent: Oct. 15, 2013

(54) TURBOMACHINE, ESPECIALLY GAS TURBINE

(75) Inventors: Urs Benz, Gipf-Oberfrick (DE); Jonas Hurter, Baden (CH); Thorsten Motzkus, Baden (CH)

(73) Assignee: Alstom Technology Ltd, Baden (CH)

( * ) Notice: Subject to any disclaimer, the term of this patent is extended or adjusted under 35 U.S.C. 154(b) by 1250 days.

(21) Appl. No.: 12/140,094

(22) Filed: Jun. 16, 2008

(65) Prior Publication Data

US 2009/0071167 A1 Mar. 19, 2009

Related U.S. Application Data

(63) Continuation of application No. PCT/EP2006/068226, filed on Nov. 8, 2006.

(30) Foreign Application Priority Data

Dec. 14, 2005 (CH) ..... 1977/05

(51) Int. Cl.
*F02C 7/28* (2006.01)
*F02C 7/30* (2006.01)

(52) U.S. Cl.
USPC ..... 60/800; 60/805

(58) Field of Classification Search
USPC ..... 60/805, 798, 800; 415/110, 113, 138
See application file for complete search history.

(56) References Cited

U.S. PATENT DOCUMENTS

| | | | | |
|---|---|---|---|---|
| 3,224,194 | A * | 12/1965 | De Feo et al. | 60/793 |
| 3,965,066 | A | 6/1976 | Sterman et al. | |
| 4,124,737 | A * | 11/1978 | Wolfla et al. | 428/640 |
| 4,379,560 | A | 4/1983 | Bakken | |
| 5,337,583 | A | 8/1994 | Giles et al. | |
| 5,749,218 | A * | 5/1998 | Cromer et al. | 60/796 |
| 6,817,187 | B2 * | 11/2004 | Yu | 60/39.17 |
| 6,834,507 | B2 * | 12/2004 | Jorgensen | 60/805 |
| 2002/0184892 | A1 * | 12/2002 | Calvez et al. | 60/796 |
| 2003/0046940 | A1 | 3/2003 | Matsuda et al. | |
| 2004/0250548 | A1 * | 12/2004 | Howell et al. | 60/796 |
| 2006/0123797 | A1 * | 6/2006 | Zborovsky et al. | 60/800 |

FOREIGN PATENT DOCUMENTS

| | | |
|---|---|---|
| CH | 633351 | 11/1982 |
| DE | 1259142 | 1/1968 |
| DE | 4324035 | 1/1995 |
| GB | 2035474 | 6/1980 |

OTHER PUBLICATIONS

DE4324035 translation Jan. 1995.*

European Patent Office, International Search Report in International Patent Application No. PCT/EP2006/068226 (Jan. 25, 2007).

* cited by examiner

*Primary Examiner* — Ted Kim

(74) *Attorney, Agent, or Firm* — Leydig, Voit & Mayer, Ltd.

(57) ABSTRACT

A turbomachine with at least one combustion chamber and at least one turbine which lies downstream of it. The turbine has at least one support element and a lining element connected to the support element and formed as a heat shield. A gap sealed by means of a seal, is formed between the at least one combustion chamber and the turbine, an exchangeable insert is arranged in the gap on the end face on the support element and protects at least the support element against hot gases which penetrate into the gap, and against oxidation which is associated with it.

15 Claims, 2 Drawing Sheets

TURBOMACHINE, ESPECIALLY GAS TURBINE

CROSS REFERENCE TO PRIOR APPLICATIONS

This application is a continuation of International Patent Application No. PCT/EP2006/068226, filed on Nov. 8, 2006, which claims priority to Swiss Patent Application No. CH 1977/05, filed on Dec. 14, 2005. The entire disclosure of both applications is incorporated by reference herein.

The present invention relates to a turbomachine, especially a gas turbine, with at least one combustion chamber and at least one turbine which lies downstream of it.

BACKGROUND

In conventional turbomachines, a lining element, for example an inner liner, is fastened on a support element, and also a membrane seal slot for a membrane seal is formed on the support element. The support element is surrounded, for example, with a compressor final temperature during operation of the turbomachine and therefore makes no really high demands on the oxidation resistance of the material. In most cases, therefore, it is sufficient if the support elements are manufactured for example from Stg50T, Stg41T, St530TS or from GGG40. In order to also be able to reduce a cooling air portion of a turbine platform in the case of such turbomachines, this platform is constructed as short as possible, as a result of which, however, the static pressure in front of the leading edge of the turbine blade increases owing to the aerodynamic resistance of a turbine blade, and causes a so-called bow wave effect. As a result of the higher static pressure in the region of the blade leading edge, the penetration of hot gas in the gap between a combustion chamber and the turbine platform can occur in turn. The parts which are exposed to impingement by hot gas, such as the inner liner or the membrane seal, are customarily manufactured from a nickel-based alloy and are therefore adequately protected even without a thermal barrier coating. On the other hand, the support elements, however, oxidize relatively intensely on account of the high temperatures which are created as a result of the hot gas penetration. In order to avoid this, a barrier coating, for example an Inconel 625 coating, is customarily deposited onto the support elements, which, however, is time-consuming to produce and gives rise to high costs. In addition, the gap across the membrane seal on the platform side is purged with cooling air. Despite these measures, however, abrasive wear on the support element in the region of an axial end face in the gap occurs, which in the worst case can lead to increased leakage up to the point of a disintegration of the sealing membrane.

SUMMARY OF THE INVENTION

An object of the present invention is to provide an improved turbomachine in which, on one hand the support elements are effectively protected against oxidation, and on the other hand, the maintenance-friendliness of the turbomachine is significantly improved.

An aspect of the present invention is to arrange an exchangeable insert on the end face on a support element in a turbomachine, in a gap between a combustion chamber and a turbine which lies downstream of it, so as to reliably protect the support element against hot gases and against oxidizing as a result. According to an aspect of the present invention, premature oxidizing of the support element can be avoided and at the same time the insert is formed so that it is to be simply and quickly exchanged, that is to say without long downtimes of the turbomachine and without high costs. In this case, the insert is arranged in the gap on the end face of the support element so that it covers the complete end face of the support element which faces the gap. Furthermore, the insert may be detachably arranged on the support element and consequently is easy to exchange when required.

According to a preferred embodiment of the present invention, the exchangeable insert is formed from an oxidation-resistant material, especially from a material which is more oxidation-resistant than the support element itself. As a result, the insert effectively prevents an undesirable oxidation of the support element, and for example may be the same composition as the heat-resistant lining element, so that the insert needs only to be replaced or maintained during a maintenance interval which is appropriate to the lining element. At the same time, it is possible, as a result, to form and inexpensively construct the support element from a material which is more suitable, for example stronger, for the construction. It is therefore not necessary to produce the support element from a similarly oxidation-resistant material, as a result of which, significant economizing effects ensue. At the same time, a temperature-resistant and/or wear-resistant end-face coating of the support element, which for one thing is difficult to apply and which for another thing is time-consuming to replace, especially in the case of maintenance, can be dispensed with. Due to the fact that the exchangeable insert can be formed from a plurality of circle segments or from two semicircular rings, it is also possible to simply exchange individual insert segments when required, as a result of which maintenance costs and maintenance time consumption can also be reduced.

In a further advantageous embodiment, the exchangeable insert is arranged in the gap between a first combustion chamber and a turbine which lies downstream of it, and/or in the gap between a second combustion chamber and a low-pressure turbine which lies downstream of it. This makes it clear that the present invention for the protection of the support elements against a hot gas penetration, and against premature oxidation as a result, can be diversely applied and used in turbomachines of various types. In particular, the exchangeable insert according to the invention may be used in various gaps of a turbomachine, since, construction elements which are at risk of oxidation are to be effectively protected. Such an insert can also be used on an inner side and/or on an outer side of an annular combustion chamber.

The insert expediently carries the seal, and/or the seal is formed as a membrane seal. With wear of the seal, which, in conventional constructions, was often arranged in a fixed manner on the support element, the complete support element previously had to be exchanged, which gave rise to long downtimes and to high costs. By means of the solution according to the invention, by releasing the insert, the seal can be simply removed in the axial direction from the end face of the support element, and can be just as simply refastened to it. Therefore, with the present invention, exchange of the whole support element not required, which may reduce the downtimes of the turbomachine and lower the costs.

In a further preferred embodiment, the seal is formed from a plurality of circle segments, or from two semicircular rings, wherein the two semicircular rings overlap in the circumferential direction. This enables the exchange of individual segments of the seal, or individual semicircular rings of the seal, as a result of which an individual and as-required maintenance of the turbomachine can be achieved. At the same time, as a result of the segmenting of the seal, an improved handling of this may be achieved, especially during maintenance, as a result of which the maintainability may be simplified and consequently maintenance costs can be lowered.

Each circle segment and/or each semicircular ring of the seal may be expediently fastened on at least one point on the insert. As a result of the high temperatures, which are especially caused by a hot gas penetration in the gap, considerable deformations occur, which have to be taken up by the seal without suffering damage. As a result of a point fixing of the segments of the seal, or semicircular rings of the seal, for one thing each of the segments or each of the half-rings is fixed on the one hand, but on the other hand allows an unobstructed temperature expansion both in the radial and circumferential directions.

Further important features and advantages of the turbomachine according to the invention result from the dependent claims, from the drawings and from the associated figure description with reference to the drawings.

BRIEF DESCRIPTION OF THE DRAWINGS

Preferred embodiments of the invention are represented in the drawings and are explained in more detail in the subsequent description. Features which are essentially or functionally the same or similar, are referred to by the same designations.

In the drawing, schematically in each case

DETAILED DESCRIPTION

Figure 1:
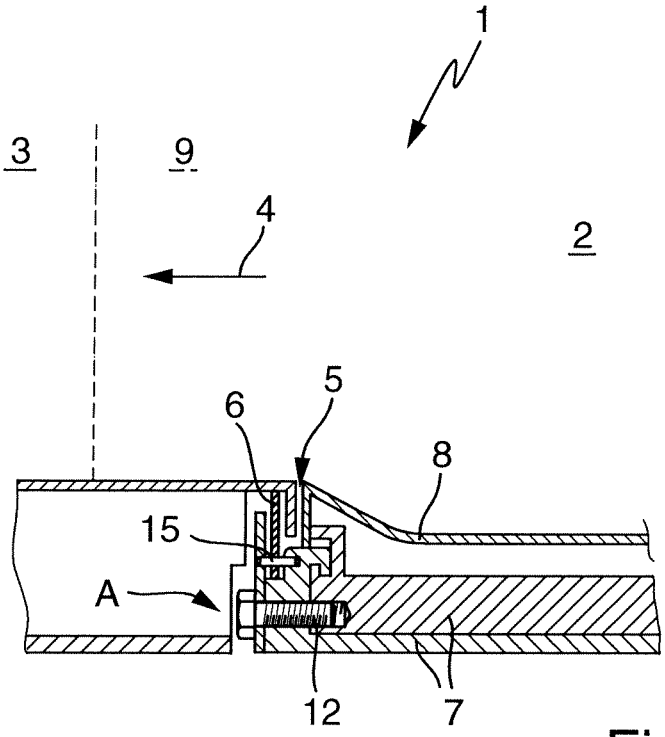
FIG. 1 shows a longitudinal section through a turbine inlet side in the region of a gap.
Figure 2:
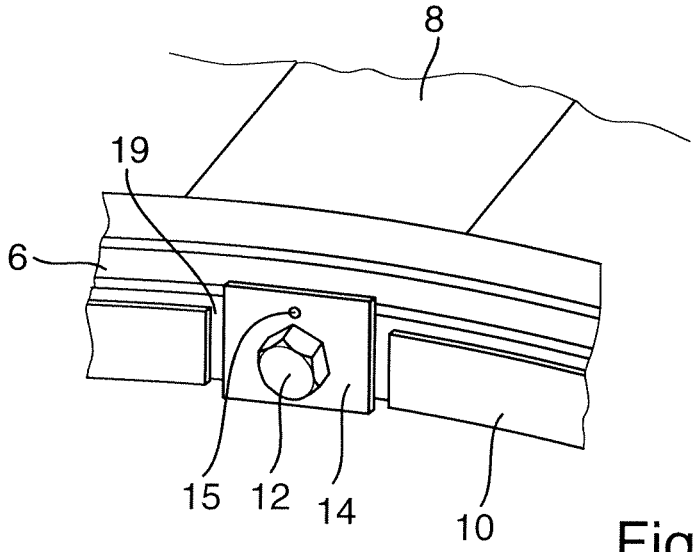
FIG. 2 shows an enlarged perspective view of the region A from FIG. 1.

In FIG. 1, a turbomachine 1 according to the invention, for example a gas turbine, has at least one combustion chamber 2 and at least one turbine 3 which lies downstream of the combustion chamber 2. The flow direction in this case, according to FIG. 1, is identified by the designation 4. A gap 5, which is sealed via a seal 6 (cf. FIGS. 2 to 4), is formed between the combustion chamber 2 and the turbine 3 which lies downstream. As shown further in FIG. 1, the turbomachine 1 has at least one support element 7 and a lining element 8 which is connected to it and formed as a heat shield.

An aim of the present invention is to create a turbine platform which is constructed as short as possible, which may achieve manufacturing advantages and advantages with regard to the operating stability. Due to the aerodynamic resistance of a blade 9, however, the static pressure in front of a leading edge in the turbine blade increases, from which a so-called bow wave effect results. As a result of the high static pressure in the region of a blade leading edge, a hot gas penetration in the gap 5 between the combustion chamber 2 and the turbine 3 can therefore occur. The parts which are exposed to impingement by hot gas, such as the lining element 8, are preferably manufactured from nickel-based alloys and therefore are adequately protected even without a separate thermal barrier coating. On the other hand, however, the support elements 7 oxidize very intensely on account of an excessively high temperature. In order to prevent a direct contact of the hot gases with the support element 7 in the gap 5, and consequently to lessen a tendency towards oxidation, an exchangeable insert 10 is arranged in the gap 5 on the end face on the support element 7 (cf. FIGS. 1 to 4). The exchangeable insert 10 is formed from an oxidation-resistant material, which may have a higher oxidation resistance than the material which is used for the support element 7. A welcome secondary effect of the short turbine 3 is also a reduced cooling air portion, as a result of which the efficiency of the turbine 3 can be increased.

On account of the circular cross section of the turbine 3, the exchangeable insert 10 is formed either from a plurality of circle segments or from two semicircular rings, wherein the circle segments in particular allow improved handling on account of their low weight. Furthermore, the advantage is consequently provided of renewing individual circle segments of the insert 10 as required, as a result of which maintenance time consumption and consequently maintenance costs can be altogether saved. The insert 10, which is arranged on the end face on the support element 7, completely covers an end face of the support element 7 so that this is completely protected against hot gases which penetrate into the gap 5. Fastening of the insert 10 on the support element 7 is carried out in this case for example via an undercut 11 on the support element side (cf. FIG. 4), in which the exchangeable insert 10 engages, and/or via at least one fastening device 12 (cf. FIGS. 2 to 4), for example a screw. This may result in easy detachability and consequently quick exchange of the insert 10 or of the seal 6 in the case of maintenance.

In order to achieve a resistance which is as high as possible against oxidation or temperature, the exchangeable insert 10 is preferably provided with a wear-resistant and/or temperature-resistant coating, or is formed entirely from a wear-resistant and/or temperature-resistant material. In the case of wear or oxidation of the insert 10, the "manageable" segments can thus be simply exchanged. Furthermore, it is possible, as a result of the higher compatible temperatures of the materials in the gap 5, to reduce the cooling air portion which is used for purging the gap 5, and consequently to increase the efficiency of the turbine 3 or of the turbomachine 1. An oxidation-resistant anti-wear coating can be realized, for example in the form of a chromium carbide coating. Such a chromium carbide coating provides the advantage of the insert 10 itself being able to be formed from a material which is similar to the support element 7, as a result of which both the insert 10 and the support element 7 have an almost identical thermal characteristic, which is especially favorable for minimizing gaps between individual segments as much as possible. In general, no limit is set to a material selection in this ease, so that in particular material pairings are used which on the one hand have a wear-minimized and oxidation-minimized characteristic, and on the other hand behave thermally in the same way as the support element 7.

Figure 3:
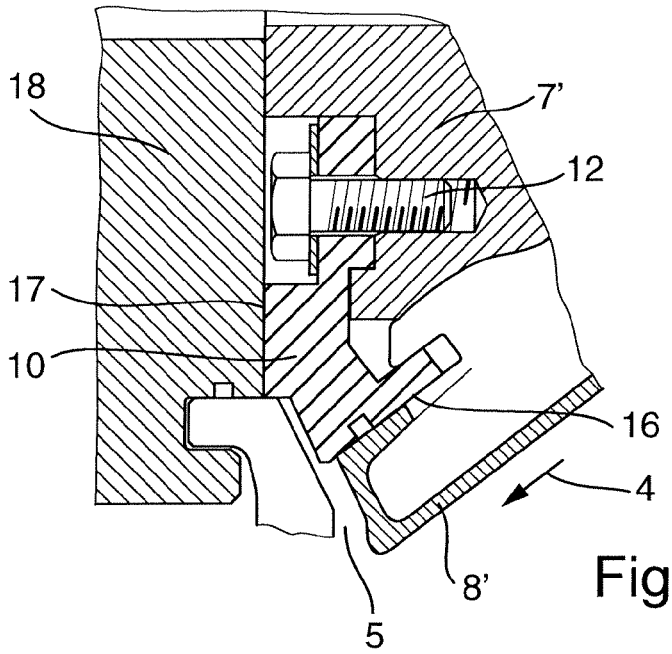
FIG. 3 shows a longitudinal section in the region of a gap between a first combustion chamber and a high-pressure turbine which lies downstream of it, with an insert according to the invention.

FIG. 3 shows a longitudinal section in the region of a gap 5 between a first combustion chamber and a high-pressure turbine. In this case, the exchangeable insert 10 is fastened on an outer support element 7 by means of a fastening device 12. At the same time, the insert 10 engages in an undercut 11 which is formed on the outer support element 7', and by its side 16 which faces away from the gap abuts against an outer lining element 8'. By a further side 17, the exchangeable insert 10 abuts against a turbine blade carrier 18. The insert 10 closes off the gap 5 according to FIG. 3 in such a way that a hot gas, which possibly penetrates from outside, cannot reach the outer support element 7' and/or the turbine blade carrier 18 and consequently protects these against oxidation. The insert 10 according to the invention can also be used in a gap 5 between a second combustion chamber and a low-pressure turbine which lies downstream of it (cf. FIG. 4).

Figure 4:
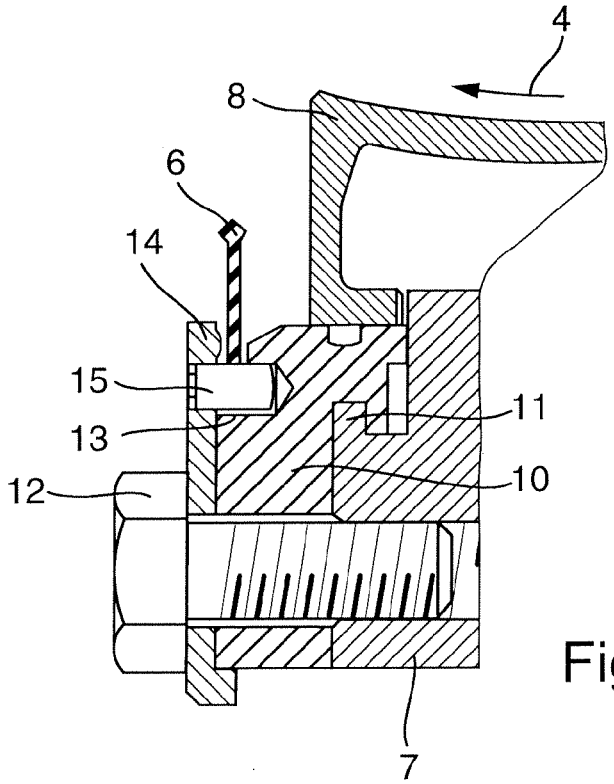
FIG. 4 shows a longitudinal section through the turbomachine in the region of a gap between a second combustion chamber and a low-pressure turbine which lies downstream of it, with the insert according to the invention.

As shown in FIG. 4, the seal 6 is arranged in an axially open step 13 on the insert 10, wherein the seal 6 is axially retained in the step 13 via detachable retaining elements 14. The insert 10, therefore, carries the seal 6 which for example is formed as a membrane seal. In this case, the seal 6, similar to the insert 10, can have a plurality of circle segments or two semicircular rings, which overlap in the circumferential direction. The retaining element 14 in this case is clamped in each case by the fastening device 12 against the insert 10 or against the support element 7, and consequently prevents an axial displacement of the seal 6. In this case, each retaining element 14 is arranged in each case in a recess 19 (cf. FIG. 2) which at least reduces a thickness of the insert 10 in the flow direction 4. By means of the recess 19, the position of the retaining element 14, which is accommodated therein in each case, is predetermined, as a result of which the installation of the retaining elements 14 is simplified.

In the circumferential direction, it is intended to fix each circle segment and/or each semicircular ring of the seal 6 on at least one point on the insert 10. When using two sealing membranes which are formed as semicircular rings, these, therefore, are preferably fixed at 12 o'clock and at 6 o'clock in each case on one point on the support element 7. On the respective fixing point, the seal 6 is fixed in the circumferential direction via a fixing pin 15, against which a radial clearance is possible in order to be able to absorb temperature expansions without suffering damage.

According to one aspect of the present invention, an easily exchangeable and consequently inexpensive oxidation protection is created for an end face of the support element 7 which is located in a gap 5, as a result of which on the one hand lower maintenance costs and shorter downtimes of the turbomachine 1 may ensue, and on the other hand a cooling air flow, with which the gap 5 is purged, can be reduced, which favorably affects the efficiency of the turbomachine 1. In this case, the insert 10 can be selectively formed entirely from an oxidation-resistant and temperature-resistant material, or can have an oxidation-resistant and temperature-resistant coating, whereas a core of the insert 10 is formed from the same material as the support element 7, 7', and consequently an almost identical temperature characteristic between insert 10 and support element 7, 7' can be achieved, which favorably affects gap widths which are possibly to be expected. Furthermore, the insert 10 carries the seal 6 which for example can be formed as a membrane seal. Owing to the circle segment-like or semicircular ring-like formation of the insert 10 or of the seal 6, an especially favorable handling both of the seal 6 and of the insert 10 is provided, as a result of which the maintenance time consumption, and consequently also the maintenance costs, can be reduced. Furthermore, this makes it possible for only the parts to be exchanged which have to be exchanged because of oxidation or erosion, while other segments of the seal, or segments of the insert, which are not so seriously damaged can remain on the support element 7. A complete exchange of the support element 7, as was previously necessary, for example, and also the long downtimes and high maintenance costs or exchange costs which were associated with it, can consequently be effectively avoided. At the same time, the cooling air flow for cooling the gap 5 can be reduced, which increases the efficiency of the turbomachine 1.

The invention claimed is:

1. A turbomachine comprising:

at least one combustion chamber;

at least one turbine lying downstream to the combustion chamber, a gap disposed between the at least one combustion chamber and the at least one turbine;

a support element having an end face facing the gap;

a lining element connected to the support element and forming a heat shield over the support element;

an exchangeable insert disposed in the gap, the exchangeable insert covering the end face of the support element so as to be exposed to hot gases and the exchangeable insert abutting the lining element so as to protect the support element against the hot gases;

a seal retained on the exchangeable insert and configured to seal the gap; and, wherein the exchangeable insert is more oxidation-resistant than the support element.

2. The turbomachine as recited in claim 1, wherein the exchangeable insert includes a plurality of circle segments.

3. The turbomachine as recited in claim 2, wherein the plurality of circle segments includes two semicircular rings.

4. The turbomachine as recited in claim 1, wherein the exchangeable insert engages in an undercut on the support element side.

5. The turbornachine as recited in claim 1, further comprising at least one fastening device and wherein the exchangeable insert is retained on the end face of the support element using the least one fastening device.

6. The turbomachinc as recited in claim 1, wherein the exchangeable insert has at least one of a wear-resistant coating and a temperature-resistant coating.

7. The turbomachine as recited in claim 1, wherein the at least one combustion chamber includes a first combustion chamber and a second combustion chamber and wherein the gap is disposed between the turbine and at least one of the first combustion chamber and the second combustion chamber.

8. The turbomachine as recited in claim 1, wherein the exchangeable insert carries the seal.

9. The turbomachine as recited in claim 1, wherein the seal is a membrane seal.

10. The turbomachine as recited in claim 1, wherein the seal includes a plurality of circle segments.

11. The turbomachine as recited in claim 10, wherein the plurality of circle segments includes two semicircular rings.

12. The turbomachine as recited in claim 10, wherein the circle segments overlap in the circumferential direction.

13. The turbomachine as recited in claim 10, wherein each circle segment is fixed on the exchangeable insert.

14. The turbomachine as recited in claim 1, further comprising an axially open step on the exchangeable insert and wherein the seal is disposed in the axially open step.

15. The turbomachine as recited in claim 1, further comprising a plurality of detachable retaining elements and wherein the seal is retained in the axially open step using the detachable retaining elements.

* * * * *